US006844800B2

(12) United States Patent
Passow et al.

(10) Patent No.: US 6,844,800 B2
(45) Date of Patent: Jan. 18, 2005

(54) SYSTEM AND METHOD FOR AUXILIARY CONTACT ASSEMBLY

(75) Inventors: Christian H. Passow, Ann Arbor, MI (US); Kevin B. Tews, North Aurora, IL (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 66 days.

(21) Appl. No.: 10/252,633

(22) Filed: Sep. 23, 2002

(65) Prior Publication Data

US 2003/0060071 A1 Mar. 27, 2003

Related U.S. Application Data

(62) Division of application No. 09/961,155, filed on Sep. 21, 2001, now Pat. No. 6,624,731.

(51) Int. Cl.[7] ..... H01H 67/02
(52) U.S. Cl. ..... 335/132; 335/202
(58) Field of Search ..... 335/132, 202; 200/16 A, 16 R, 243–248, 250; 29/602.1, 622

(56) References Cited

U.S. PATENT DOCUMENTS 4,224,489 A * 9/1980 Dietrich ..... 200/447

5,886,602 A * 3/1999 Burel et al. ..... 335/132

* cited by examiner

*Primary Examiner*—Lincoln Donovan

(57) ABSTRACT

A contact assembly for use in an electrical switching apparatus has an actuator. An enclosure comprises an interior space housing first and second stationary contacts fixedly mounted in spaced relation with one another in one of a normally closed position or a normally open position. A pusher is movably mounted in the enclosure and is selectively driven by the actuator to move between a normal position and an actuated position. The pusher comprises a top wall, a bottom wall and first and second side walls connected between the top wall and bottom wall to define an opening having respective first and second ends. First and second longitudinally spaced top ribs are on an inside of the top wall proximate the respective first and second side walls. First and second longitudinally spaced bottom ribs are in an inside of the bottom wall proximate the respective first and second side walls and laterally offset from the respective first and second top ribs. A movable contact is received in the opening. A contact spring is captured between the top rib and the bottom rib at either the first or the second end of the opening to bias the movable contact against the top rib and the bottom rib at the other of the first end and second end of the opening.

19 Claims, 5 Drawing Sheets

SYSTEM AND METHOD FOR AUXILIARY CONTACT ASSEMBLY

CROSS-REFERENCE TO RELATED PATENT APPLICATIONS

This application is a division of U.S. patent application Ser. No. 09/961,155 filed Sep. 21, 2001, now U.S. Pat. No. 6,624,731.

The present U.S. patent application having at least one common inventor as

U.S. patent application Ser. No. 09/961,159 entitled "System and Method for Auxiliary Contact Assembly and Snap Mounting", and U.S. patent application Ser. No. 09/961,165 entitle "System and Method for Mounting a Pusher and Moveable Contact in a Contact Block", and U.S. patent application Ser. No. 09/961,156 entitle "System and Method for Mounting a Moveable Contact in a Contact Block", and U.S. patent application Ser. No. 09/961,158 entitled "Contact Block Assembly and Method of Assembling a Contact Block Assembly", and U.S. patent application Ser. No. 09/961,161 entitled "Pusher Assembly and Method for Assembling a Pusher Assembly", U.S. patent application Ser. No. 09/961,160 entitled "Movable Contact and a Method of Assembling a Pusher Assembly having a Movable Contact", are filed with the U.S. Patent and Trademark Office concurrently on Sep. 21,2001, the entirety of each being incorporated herein by reference.

TECHNICAL FIELD OF THE INVENTION

This invention relates to a contact assembly for use in an electrical switching apparatus designed to minimize incorrect assembly.

BACKGROUND OF THE INVENTION

A conventional electrical switching apparatus in one form typically comprises an electromagnetically actuated device having a magnetic core proximate an armature. Typically, a coil is electrically energized to draw the armature to the magnetic core. The electromagnetically actuated device may be a control relay, a contactor, a motor starter or the like. The armature is operatively associated with a movable device such as an actuator. With an electrical switching apparatus the actuator operates a contact assembly.

A contact assembly may be an integral component of the electrical switching apparatus or it may be an auxiliary device to be added thereto. In either case, the contact assembly typically includes a contact having a pair of stationary contacts and a movable contact. In one known form of a contact assembly, a pusher is movably mounted in an enclosure. The stationary contacts are fixedly mounted in spaced relation with one another. The movable contact is mounted to the pusher. The contact assembly may provide for normally open contact operation or normally closed contact operation. In some conventional contact designs a different geometry stationary contact is used for normally open and normally closed stationary contacts. However, a problem exists in that a simple continuity test may not detect whether the incorrect stationary contacts are installed in such a design. Moreover, the movable contact may include silver contact points on one side of a conductive bar. A simple continuity test will not detect whether the movable contact is facing in the correct direction.

An additional problem of a conventional contact assembly is the improper installation of the pusher. If the pusher moves in a linear direction, and it is mistakenly mounted in an inverted position, then the movable contact will not line up properly with the stationary contacts. Some conventional designs use a small tab on the pusher received in a pocket in the enclosure. However, incorrect assembly may not be obvious during installation until after the cover and housing forming the enclosure are riveted together and the pusher binds during testing. At this point in the manufacturing process the problem is discovered, but the parts may not be salvageable.

Additionally, different variations of contact assemblies may require the availability of multiple pusher designs based on the location and orientation of the movable contacts. For example, both contacts can be normally opened, both contacts can be normally closed, one contact can be normally open and the other normally closed. Additionally, the timing of one contact opening and the other closing can also be altered. These variations necessitate additional parts inventory resulting in loss of economies of scale.

Accordingly, there is a need for a contact assembly for use in an electrical switching apparatus designed to eliminate opportunity of incorrect assembly.

SUMMARY OF THE INVENTION

In accordance with the invention there is provided a contact assembly for use in an electrical switching apparatus designed to eliminate opportunity of incorrect assembly.

In accordance with one aspect of the invention there is disclosed a contact assembly for use in an electrical switching apparatus having an actuator. An enclosure comprises an interior space housing first and second stationary contacts fixedly mounted in spaced relation with one another in one of a normally closed position or a normally open position. A pusher is movably mounted in the enclosure and is selectively driven by the actuator to move between a normal position and an actuated position. The pusher comprises a top wall, a bottom wall and first and second side walls connected between the top wall and bottom wall to define an opening having respective first and second ends. First and second longitudinally spaced top ribs are on an inside of the top wall proximate the respective first and second side walls. First and second longitudinally spaced bottom ribs are in an inside of the bottom wall proximate the respective first and second side walls and laterally offset from the respective first and second top ribs. A movable contact is received in the opening. A contact spring is captured between the top rib and the bottom rib at either the first or the second end of the opening to bias the movable contact against the top rib and the bottom rib at the other of the first end and second end of the opening.

It is a feature of the invention that facing surfaces of the first top rib and first bottom rib and the second top rib and second bottom rib are arcuate.

It is another feature of the invention that a portion of each rib at its proximate side wall extends laterally to define a seat for the contact spring.

It is still another feature of the invention that the top ribs are spaced from the bottom ribs to define slots therebetween, whereby the movable contact can be mounted to the pusher by inserting it into the pusher in one of the slots, pressing the movable contact against the contact spring and rotating the movable contact to engage the top rib and the bottom rib at the other of the first end and second end of the opening.

It is a further feature of the invention that the movable contact comprises an elongate bar having contact pads at opposite ends of one face, and a notch on each longitudinal edge of the bar. The notches are longitudinally offset from one another. The pusher top wall and bottom wall have a width that varies in a region where the movable contact is received to coact with the offset notches so the movable contact is installed in a proper orientation. Particularly, the top wall includes offset first and second top notches at first and second longitudinal edges in the region where the movable contact is received and wherein the bottom wall includes offset first and second bottom notches at its first and second longitudinal edges in the region where the movable contact is received. The first top notch is offset from the first bottom notch and the second top notch is offset from the second bottom notch.

It is yet another feature of the invention that the first and second stationary contacts are of a first configuration for normally closed operation and a second configuration for normally open operation. The configurations are selected so that the movable contact does not contact the stationary contact if an incorrect configuration is fixedly mounted in the enclosure.

It is still another feature of the invention that the pusher comprises a neck extending through an opening in the enclosure for engagement with the actuator and the enclosure comprises an asymmetric rib on one side of the opening and the pusher comprises an asymmetric notch in the top wall on one side of the neck receiving the rib to prevent incorrect assembly of the pusher in the enclosure.

There is disclosed in accordance with another aspect of the invention a contact assembly for use in an electrical switching apparatus having an actuator. The contact assembly comprises an enclosure comprising an interior space housing first and second stationary contacts fixedly mounted in spaced relation with one another in one of a normally closed position or a normally open position. A pusher is movably mounted in the enclosure and is selectively driven by the actuator to move between a normal position and an actuated position. The pusher comprises a top wall, a bottom wall and first and second side walls connected between the top wall and bottom wall to define an opening having respective first and second ends. A first pair of ribs at the opening first ends defines a first slot therebetween. A second pair of ribs at the opening second end defines a second slot therebetween. The slots, in cross section, are partially circular. A movable contact is received in the opening. A contact spring is captured in the first slot or the second slot to bias the movable contact against the respective second pair or the first pair of ribs.

There is disclosed in accordance with yet another aspect of the invention the method of assembling a contact assembly for use in an electrical switching apparatus having an actuator. The method comprises providing an enclosure comprising an interior space housing first and second stationary contacts fixedly mounted in spaced relation with one another in one of a normally closed position or a normally open position. A pusher is provided comprising a top wall, a bottom wall and first and second side walls connected between a top wall and a bottom wall defining an opening having respective first and second ends. A first pair of ribs at the opening first end define a first slot therebetween. A second pair of ribs at the opening second end define a second slot therebetween. The slots, in cross section, are partially circular. A contact spring is inserted in the first slot or the second slot to be captured by the respective first pair of ribs or the second pair of ribs. A movable contact is inserted in the pusher by inserting the movable contact in the other of the first and second slots, pressing the movable contact against the contact spring and rotating the movable contact to engage the respective first or second pair of ribs. The pusher is inserted in the enclosure for selective movement by the actuator to move between a normal position and an actuated position to selectively make or break electrical contact between the movable contact and the stationary contacts.

Further features and advantages of the invention will be readily apparent from the specification and from the drawings.

DETAILED DESCRIPTION OF THE INVENTION

Figure 1:
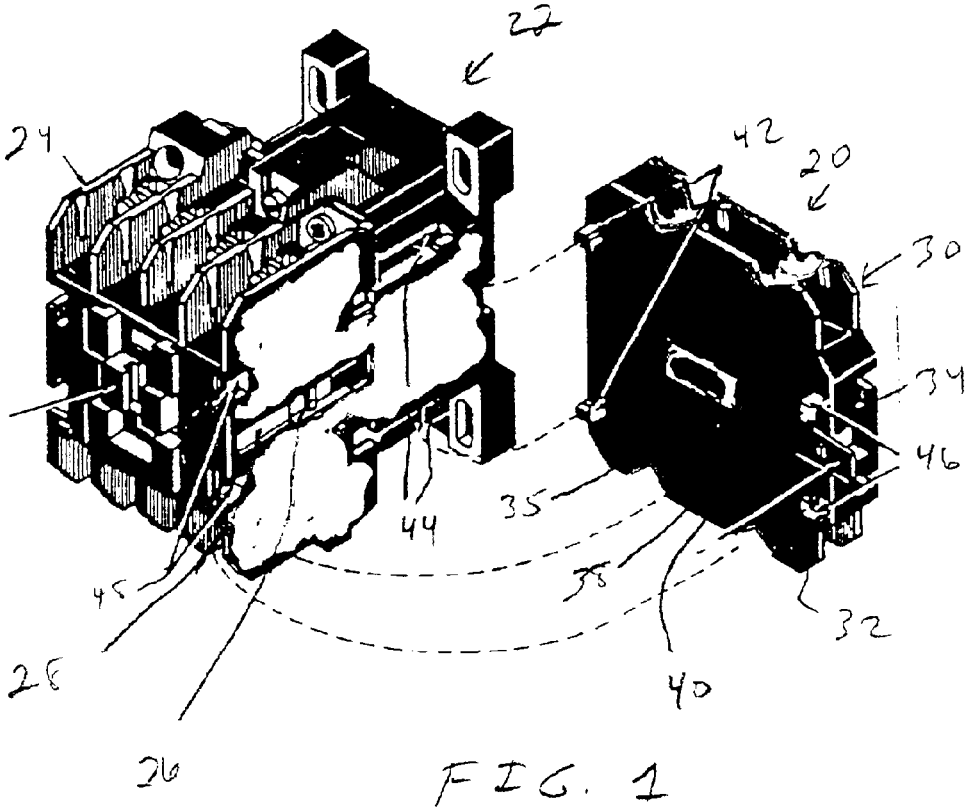
FIG. 1 is a perspective view illustrating mounting of a contact assembly in accordance with the invention onto an electrical contactor.

Referring to FIG. 1, a contact assembly in the form of an auxiliary contact block 20 for use with an electrical switching apparatus in the form of an electrical contactor 22 is illustrated. The electrical contactor 22 is of conventional construction and includes a housing 24 which may be of an insulating plastic. Although not specifically illustrated herein, the housing 24 encloses an electrical coil associated with a magnetic core and armature for driving an actuator 26 positioned in a side opening 28 of the housing 24. Additionally, the housing 24 encloses various electrical contacts which can be opened or closed responsive to energization of the coil.

Figure 3:
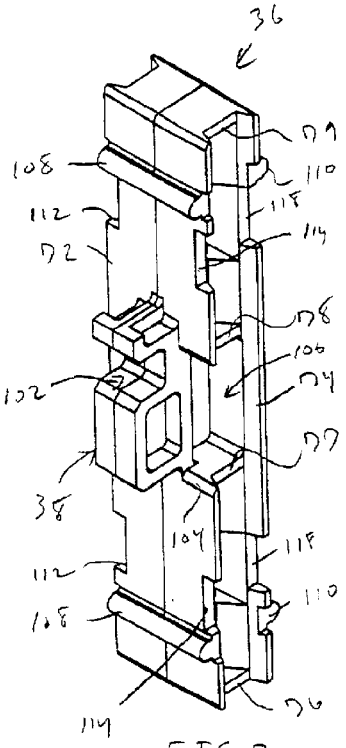
FIG. 3 is a perspective view for a pusher of the contact assembly of FIG. 1.
Figure 4:
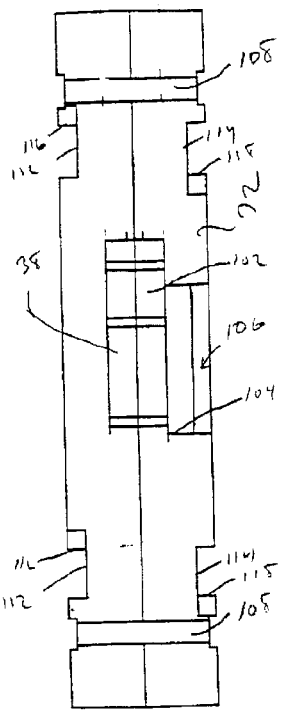
FIG. 4 is a plan view of the pusher of FIG. 3.
Figure 5:
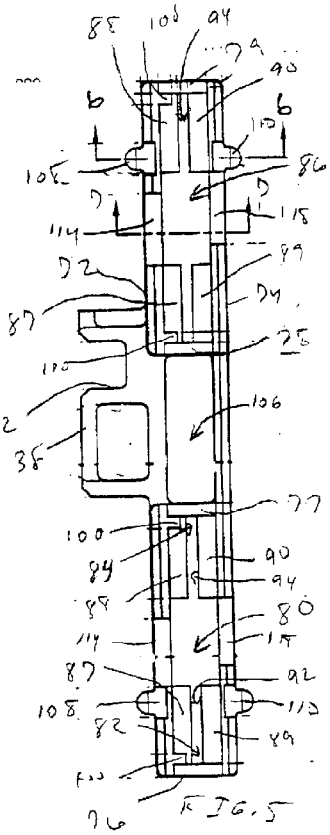
FIG. 5 is a side elevation view of the pusher of FIG. 3.

The auxiliary contact block 20 includes an enclosure 30. The enclosure 30 is formed of a housing 32 and cover 34 which are held together in a conventional manner to define an interior space 35. A plunger 36, see FIG. 3, in the interior space 35 includes a neck 38 extending through an opening 40 in the housing 32. The housing includes rear ears 42 received in notches 44 of the contactor housing 24 and front ears 46 for engaging indentations 48 at a front edge of the housing 24 to provide a snap-on device. Particularly, the auxiliary contact block 20 is slid on to the contactor 22 so that the rear ears 42 engage in the contactor slots 44. The front ears 46 are then properly aligned with the indentations 48 and snapped into place. Incident to installation of the contact block 20 on the contactor 22, the actuator 26 engages the neck 38 so that the pusher 36 is driven by the actuator 26 in a conventional manner.

While the present invention is described in connection with an electrical contactor 22 and auxiliary contact block 20, the invention may be used with other electrical switching apparatus such as, for example, control relays, motor starters, solenoids or the like.

Figure 2:
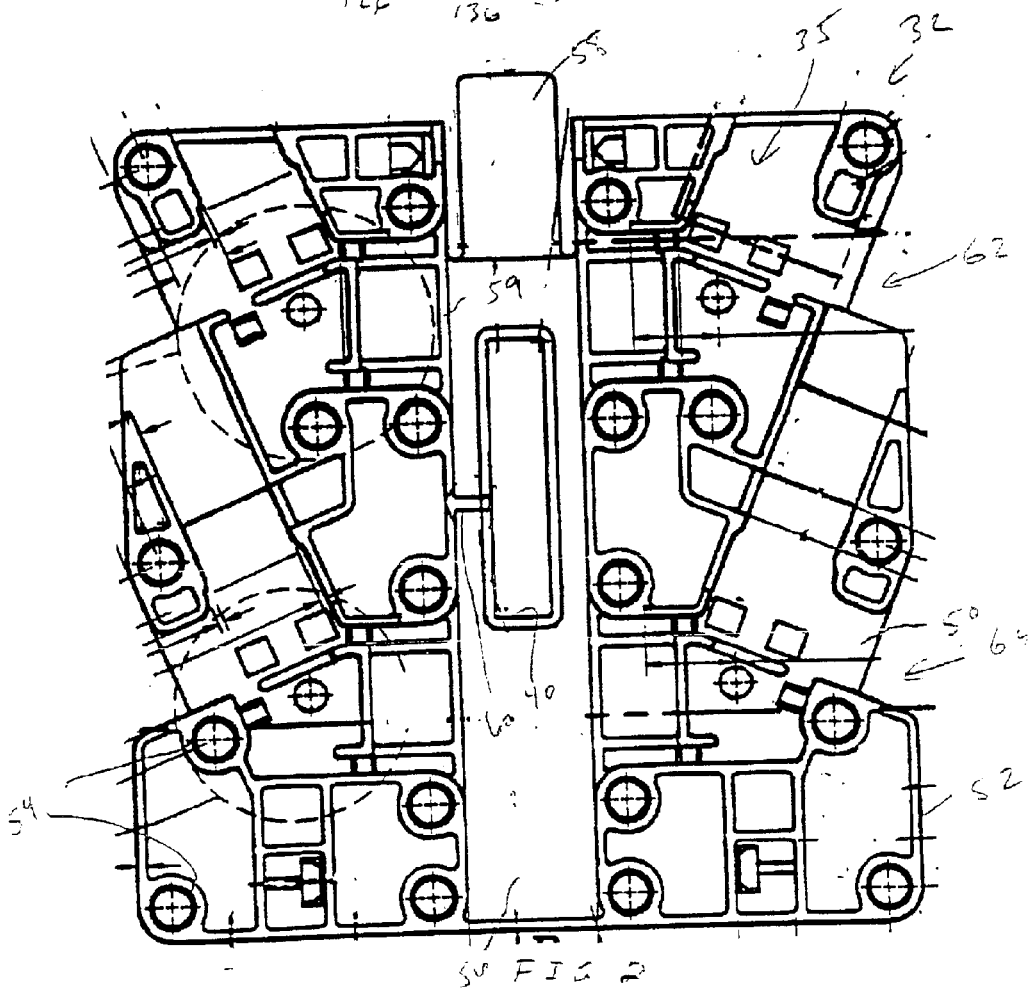
FIG. 2 is a plan view of a housing for the contact assembly of FIG. 1.

Referring to FIG. 2, the enclosure housing 32 is illustrated in greater detail. The housing 32 may be formed of an insulating plastic and is of one-piece construction. The housing includes a generally planar base 50 having a short peripheral side wall 52. A plurality of collars 54 extend upwardly from the base 50 for receiving posts (not shown) of the cover 34 to retain the cover 30 on the housing 32 in a conventional manner.

A central planar area 56 extends longitudinally and ends with a tab 58. The opening 40 is provided in the central planar area 56. An asymmetric rib 60 extends upwardly from the central planar area on one side of the opening 40. As described below, the plunger 36 is slidably received on the central planar area 56 with the neck 38 extending through the opening 40, as discussed above.

The housing 32 includes a network of internal walls and ribs 59 and the like of varying height to maintain the plunger 36 and stationary contacts, described below, in desired positions. This network of internal walls and ribs 59 is not specifically described herein but is illustrated in FIG. 2. As is apparent, the configuration can be adapted as necessary according to size and spacing requirements and the like on any particular contact assembly as will be apparent to those skilled in the art. Also, the cover 34 will include a corresponding network of walls and ribs (not shown).

Figure 13:
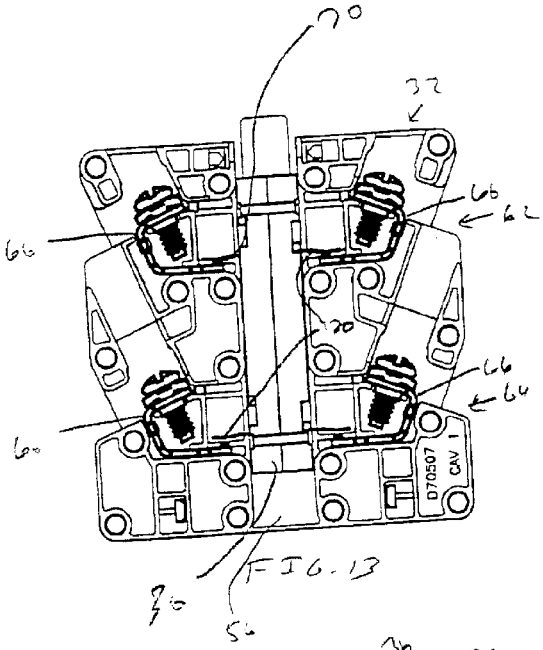
FIGS. 13–15 illustrate alternative configurations of movable contact and stationary contacts in the housing of FIG. 2.
Figure 14:
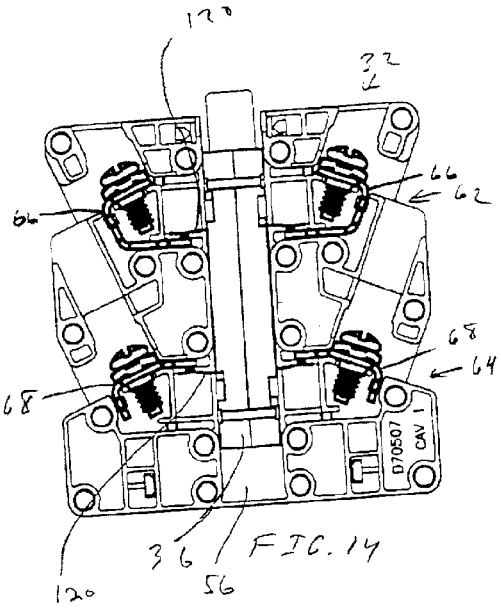
Figure 15:
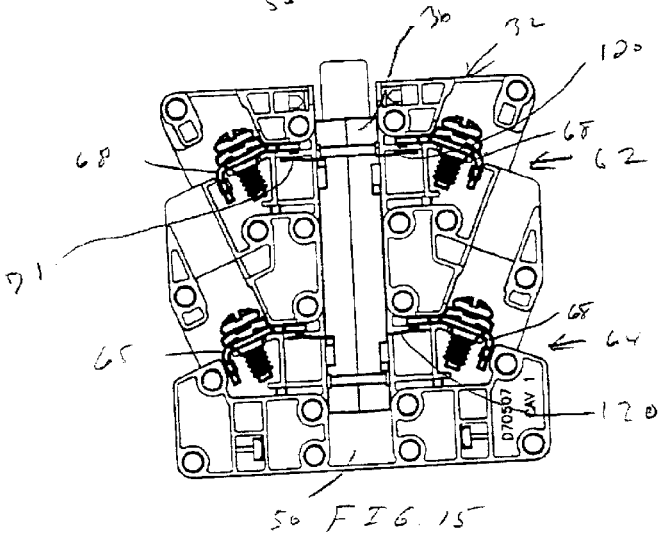

The contact assembly 20 is adapted to provide either one or two electrical contacts. The contact or contacts can be any combination of normally open and normally closed operation. As such, the housing 32 defines a first contact area 62 located generally above the opening 40 and a second contact area 64 located generally below the opening 40. As will be appreciated, the particular location of the contact areas may be different from that specifically described herein. Each contact area 62 and 64 may include first and second stationary contacts (not shown in FIG. 2) fixedly mounted in a spaced relation with one another on either side of the central portion 56 in one of a normally closed position or a normally open position. For example, FIG. 13 illustrates the housing 32 with two normally open stationary contacts 66 in both the first contact area 62 and the second contact area 64. FIG. 14 illustrates normally open stationary contacts 66 in the first contact area 62 and normally closed stationary contacts 68 in the second contact area 64. Finally, FIG. 15 illustrates the housing 32 with two normally closed stationary contacts 68 in both the first contact area and the second contact area 64. As is apparent, the normally closed contacts 66 are of a different configuration from the normally open contacts 68. Particularly, the normally closed contacts 66 are generally longer and include an upwardly facing silver contact point 70, see FIG. 13, while the normally open contacts 68 are generally shorter and include a downwardly facing silver contact point 72. Owing to the different configuration, the normally closed contact faces upwardly in a lower region of the contact areas 62 or 64, while the normally open contacts 68 include a downwardly facing contact point 71 in an upper region of the contact areas 62 or 64.

Referring to FIGS. 3–7, the pusher 36 is illustrated. The pusher 36 is of one-piece plastic construction. The pusher includes a top wall 72, a bottom wall 74 and four side walls 76, 77, 78 and 79 connected between the top wall 72 and the bottom wall 74. The top wall 72, bottom wall 74 and first and second side walls 76 and 77 define a first opening 80 having a first end 82 proximate the first side wall and a second end 84 proximate the second side wall 77. Similarly, the top wall 72, bottom wall 74, and third and fourth side walls 78 and 79 define a second through opening 86. The second through opening 86 is otherwise similar to the first through opening 80 and therefore like reference numerals are used to discuss details of each through opening 80 and 86.

Figure 6:
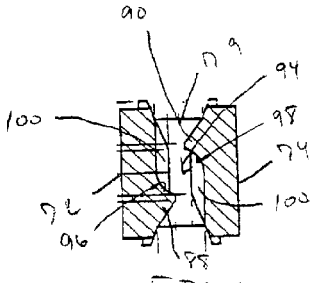
FIG. 6 is a sectional view taken along the line 6—6 of FIG. 5.
Figure 7:
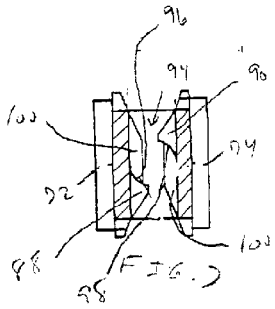
FIG. 7 is a sectional view taken along the line 7—7 of FIG. 5.

First and second longitudinally spaced top ribs 87 and 88 are on an inside of the top wall 72 proximate the respective first and second side walls 76 and 77. First and second longitudinally spaced bottom ribs 89 and 90 are in an inside of the bottom wall 74 proximate the respective first and second side walls 76 and 77. The first top rib 87 and first bottom rib 89 define a first slot 92 at the through opening first end 82. The second top rib 88 and second bottom rib 90 define a second slot 94 at the through opening second end 86. The top ribs 87 and 88 are laterally offset from the bottom ribs 89 and 90, as shown in FIGS. 6 and 7. Moreover, the top ribs 87 and 88 include an arcuate surface 96 facing a similar arcuate surface 98 on the bottom ribs 89 and 90. As such, the slots 92 and 94, in cross section, are partially circular, as shown in FIGS. 6 and 7. Additionally, each rib 87–90, at its proximate side walls 76 or 78 extends laterally to define a seat 100.

The neck 38 extends upwardly from the top wall 72 and is approximately centrally located. The head 38 includes an inset portion 102 for receiving the actuator 26, see FIG. 1. An asymmetric notch 104 is provided on the top wall 72 on one side of the head 38. The notch 104 defines a pocket 106 for receiving the asymmetric rib 60, see FIG. 2, to eliminate incorrect assembly of the pusher 36 in the housing 32.

A pair of slide elements 108 extends transversely at each end of the top wall 72. Similarly, slider elements 110 extend transversely from the bottom wall 74 proximate each end thereof. The slider elements 108 ride on the housing central area 56 to provide enhanced slidability. Similarly, the slider elements 110 slide on a similar planar area (not shown) on the cover 34, as will be apparent.

The pusher top wall 72 and bottom wall 74 have a width that varies in a region proximate the openings 80 and 86 where movable contacts are received so the movable contacts are installed in a proper orientation. Particularly, associated with each through opening 80 and 86, the top wall 72 includes offset first and second notches 112 and 114 generally centrally located between the side walls 76 and 77. The bottom wall 74 includes offset first and second bottom notches 116 and 118. Additionally, the first top notch 112 is offset from the first bottom notch 116. Similarly, the second top notch 114 is offset from the second bottom notch 118. Further, the first top notch 112 is longitudinally aligned with the second bottom notch 118, while the second top notch 114 is longitudinally aligned with the first bottom notch 116.

Figure 8:
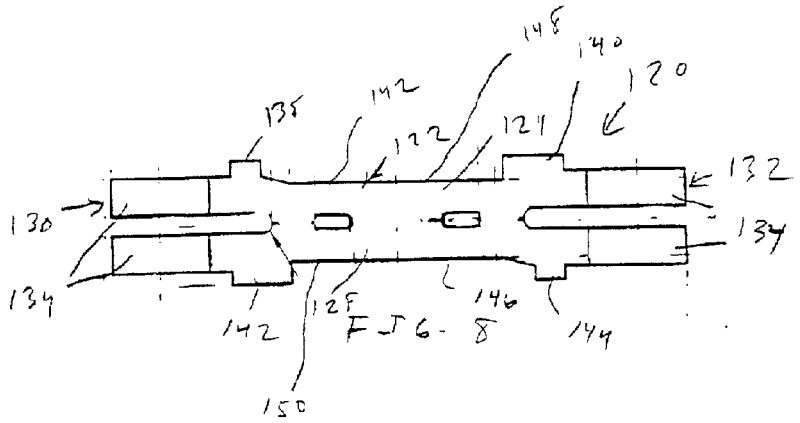
FIG. 8 is a top plan view of a movable contact of the contact assembly of FIG. 1.
Figure 9:
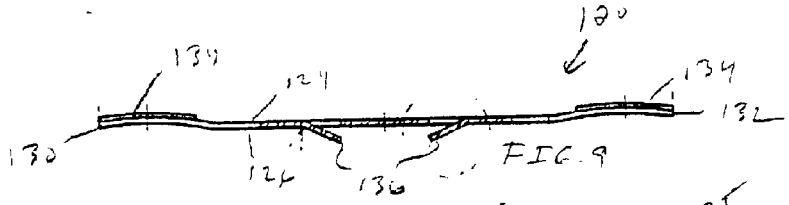
FIG. 9 is a side elevation view of the movable contact of FIG. 8.

Referring to FIGS. 8 and 9, a movable contact 120 in accordance with the invention is illustrated. The movable contact 120 comprises an elongate bar 122 having an upper face 124 and a lower face 126. The bar 122 is formed of a conductive material. The bar 122 has a central arm 128 connecting opposite bifurcated contact ends 130 and 132. Contact pads, which may comprise silver contact pads, 134, are provided on the upper face 124 at each end 130 and 132. Tabs 136 extend downwardly from the arm 128.

A first tab 138 and second tab 140 extends transversely from a first longitudinal edge 142. The tabs 138 and 140 are equally spaced from the respective ends 130 and 132. However, the first tab 138 is of a shorter length than the second tab 140. Third and fourth tabs 142 and 144 extend laterally from a second longitudinal edge 146. The tabs 142 and 144 are equally longitudinally spaced from the respective ends 130 and 132. The third tab 142 is longer than the fourth tab 144. Particularly, the first and fourth tabs 138 and 144 are of a similar length, while the second and third tabs 140 and 142 are of a similar length. The first and second tabs 138 and 140 define a notch 148 on the first longitudinal edge 142 which is longitudinally offset from a second notch 150 on the second longitudinal edge 146. As will be apparent, the first and fourth tabs 138 and 144 could also be of shorter height than the second and third tabs 140 and 142, and, in fact, could be eliminated entirely.

Figure 10:
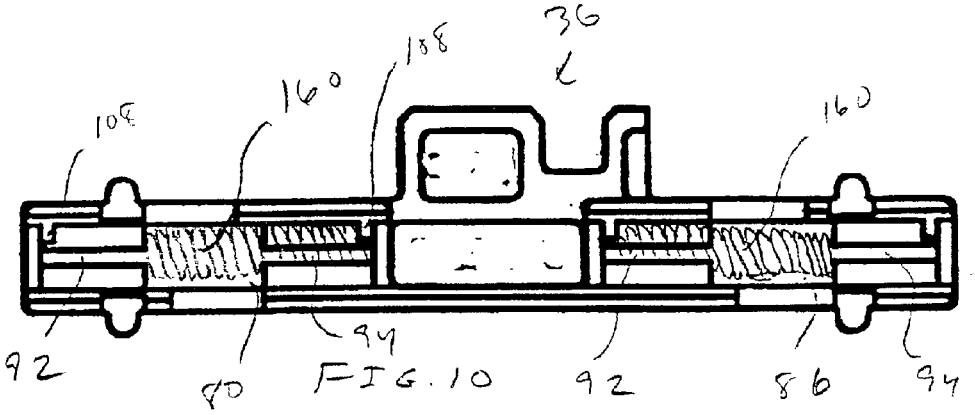
FIGS. 10–12 illustrate a sequence for mounting the movable contact of FIG. 8 to the pusher of FIG. 3.

The method of assembling the contact assembly 20 in accordance with the invention is now described in connection with FIGS. 10–12. Referring initially to FIG. 10, a contact spring 160 is positioned in each through opening 80 and 86. Particularly, the contact spring 80 is inserted in either the first slot 92 or second slot 94 of each through opening 80 or 86. The contact spring 160 is received in the generally circular slot defined by the arcuate rib surfaces 96 and 98, see FIGS. 6 and 7. Whether the contact spring 160 is inserted in the first slot 92 or the second slot 94 depends on whether it is to use with a normally open contact configuration or a normally closed contact configuration. In the illustrated embodiment of the invention, one contact spring 160 is inserted in the second slot 94 of the first through opening to provide for normally closed operation, while another contact spring 160 is positioned in the first slot 92 of the second through opening 86 to provide for normally open operation.

Figure 11:
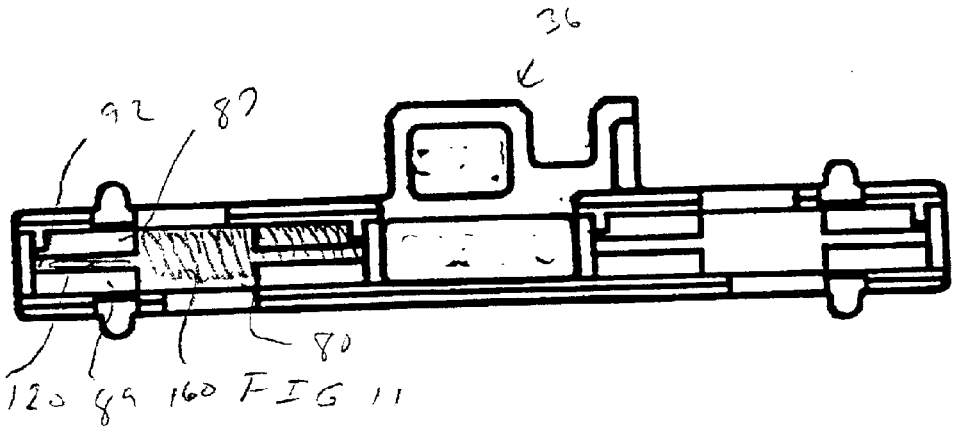
Figure 12:
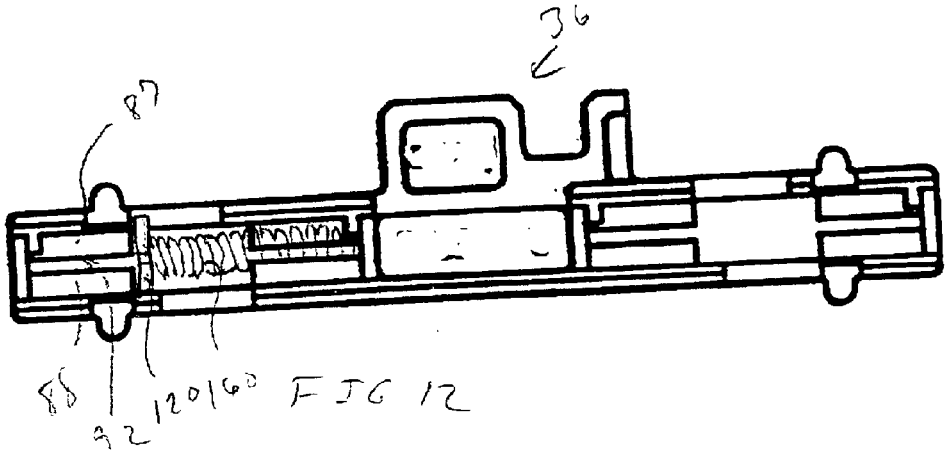

Next, and referring to FIG. 11, the movable contact 120 is turned sideways and inserted lengthwise into the first slot 92 of the first through opening 80. The movable contact 120 is then pressed against the contact spring 160, as by moving it to the right in FIG. 11, until it clears the slot 92. The contact spring 120 is then rotated ninety degrees around its elongate axis and released to allow the contact spring 160 to hold it in place against the first top rib 87 and first bottom rib 89 as shown in FIG. 12. As is apparent, a similar operation may be used to insert a movable contact 120 in the second through opening 86.

As described herein, the pusher 36 includes similar geometry at both ends associated with the through openings 80 and 86 to allow contact springs 160 and movable contacts 120 to be mounted facing in either direction. The contact spring 160 is seated in the particular slot on the seat 108 but the slots 92 and 94 extend beyond the seat 108 to simplify installation of the movable contact 120. Particularly, this enables the movable contact 120 to be slid in place as in FIG. 11 without interference from the contact spring 160.

Moreover, the use of the offset notches 112, 114, 116 and 118 of the pusher 36 and the offset notches 142 and 150 of the movable contact 120, prevents the movable contact 120 from being installed upside down. Particularly, the longer tabs 140 and 142 must be received in the slots 114 and 116 when the contact spring 160 is in the second slot 94. Conversely, the longer tabs 140 and 142 must be received in the first top notch 112 and second bottom notch 118 when the contact spring is received in the first slot 92. In other words, the contact pads 134 must face away from the contact spring 160. Thus, the use of the pusher top wall 72 and bottom wall 74 having a width that vanes in a region where the movable contact 120 is received coacts with the movable contact offset notches 142 and 150 so that the movable contact 120 is installed in a proper orientation.

Independently of the assembly of the pusher 36 and movable contact 120, the stationary contacts 66 or 68 are inserted in the housing 32. The configuration of the contacts 66 and 68 can be as shown in any of FIGS. 13–15, discussed above. Thereafter, the pusher 36 is inserted in the housing 32 in the central area 56 so that the asymmetrical rib 60 is received in the plunger pocket 106 and the neck 38 extends through the opening 40. Due to the different configuration for the normally closed contact 66 and normally open contact 68, a simple continuity test will detect whether the correct stationary contacts are installed according to the orientation of the movable contact 120. Particularly by comparing FIGS. 13 and 14, it is apparent that there is a substantially different longitudinal position of the movable contact 120 in the second contact area 64 when used for normally closed operation as in FIG. 13 and normally open operation as in FIG. 14. As such, if normally closed stationary contact 68 were inserted in the first contact area 64 in the example of FIG. 13, then the spacing between the movable contact 120 and contact pads for normally open stationary contact 68 would be substantial and contact would never be made therebetween.

The final step of assembly is to mount the cover 34 to the base 32 in a conventional manner and capture the parts therebetween. The contact assembly 20 may then be installed on an electrical contactor 22 in the manner discussed above.

It can therefore be appreciated that a new and novel system and method for auxiliary contact assembly has been described. It will be appreciated by those skilled in the art that, given the teaching herein, numerous alternatives and equivalents will be seen to exist which incorporate the disclosed invention. As a result, the invention is not to be limited by the foregoing exemplary embodiments, but only by the following claims.

We claim:

1. The method of assembling a contact assembly for use in an electrical switching apparatus having an actuator, comprising:

providing an enclosure comprising an interior space housing first and second stationary contacts fixedly mounted in spaced relation with one another in one of a normally closed position or a normally open position;

providing a pusher, the pusher comprising a top wall, a bottom wall and first and second side walls connected between the top wall and the bottom wall to define an opening having respective first and second ends, first and second longitudinally spaced top ribs on an inside of the top wall proximate the respective first and second side walls, first and second longitudinally spaced bottom ribs on an inside of the bottom wall proximate the respective first and second side walls and laterally offset from the respective first and second top ribs;

inserting a contact spring between the top rib and the bottom rib at either the first or the second end of the opening;

inserting a moveable contact in the pusher so the contact spring biases the moveable contact against the top rib and the bottom rib at the other of the first end and second end of the opening; and inserting the pusher in said enclosure for selective movement by the actuator to move between a normal position and an actuated position to selectively make or break electrical contact between the moveable contact and the stationary contacts.

2. The method of claim 1 wherein facing surfaces of the first top rib and first bottom rib and the second top rib and second bottom rib are arcuate.

3. The method of claim 1 wherein a portion of each rib at its proximate side wall extends laterally to define a seat for the contact spring.

4. The method of claim 1 wherein the top ribs are spaced from the bottom ribs to define slots therebetween, and wherein inserting the moveable contact in the pusher comprises inserting the moveable contact in one of the slots, pressing the moveable contact against the contact spring and rotating the moveable contact to engage the top rib and the bottom rib at the other of the first end and second end of the opening.

5. The method of claim 1 wherein the moveable contact comprises an elongate bar having contact pads at opposite ends of one face, and a notch on each longitudinal edge of the bar, the notches being longitudinally offset from one another, the pusher top wall and bottom wall having a width that varies in a region where the moveable contact is received to coact with the offset notches so the moveable contact is installed in a proper orientation.

6. The method of claim 5 wherein the top wall includes offset first and second top notches at its first and second longitudinal edges in the region where the moveable contact is received and wherein the bottom wall includes offset first and second bottom notches at its first and second longitudinal edges in the region where the moveable contact is received, and wherein the first top notch is offset from the first bottom notch and the second top notch is offset from the second bottom notch.

7. The method of claim 1 wherein the first and second stationary contacts are of a first configuration for normally closed operation and a second configuration for normally open operation, the configurations being selected so that the movable contact does not contact the stationary contacts if an incorrect configuration is fixedly mounted in the enclosure.

8. The method of claim 1 wherein the pusher comprises a neck extending through an opening in the enclosure for engagement with the actuator and the enclosure comprises an asymmetric rib on one side of the opening and the pusher comprises an asymmetric notch in the top wall on one side of the neck receiving the rib to prevent incorrect assembly of the pusher in the enclosure.

9. The method of claim 1 wherein the top ribs are spaced from the bottom ribs to define slots therebetween, the slots, in cross section, being partially circular.

10. The method of assembling an auxiliary contact assembly for use in an electrical switching apparatus having an actuator, comprising:

providing an enclosure comprising an interior space housing first and second stationary contacts fixedly mounted in spaced relation with one another in one of a normally closed position or a normally open position;

providing a pusher, the pusher comprising a top wall, a bottom wall and first and second side walls connected between the top wall and the bottom wall to define an opening having respective first and second ends, first and second longitudinally spaced top ribs on an inside of the top wall proximate the respective first and second side walls, first and second longitudinally spaced bottom ribs on an inside of the bottom wall proximate the respective first and second side walls and laterally offset from the respective first and second top ribs to define respective first and second slots therebetween;

inserting a contact spring in one of the first or second slots between the top rib and the bottom rib at the respective first or the second end of the opening, the contact spring extending to the top rib and the bottom rib at the other of the first end and second end of the opening;

inserting a moveable contact in the pusher by inserting the moveable contact in the other of the first and second slots, pressing the moveable contact against the contact spring and rotating the moveable contact to engage the top rib and the bottom rib at the other of the first end and second end of the opening so the contact spring biases the moveable contact against the top rib and the bottom rib at the other of the first end and second end of the opening; and inserting the pusher in said enclosure for selective movement by the actuator to move between a normal position and an actuated position to selectively make or break electrical contact between the moveable contact and the stationary contacts.

11. The method of claim 10 wherein facing surfaces of the first top rib and first bottom rib and the second top rib and second bottom rib are arcuate.

12. The method of claim 10 wherein a portion of each rib at its proximate side wall extends laterally to define a seat for the contact spring.

13. The method of claim 10 wherein the moveable contact comprises an elongate bar having contact pads at opposite ends of one face, and a notch on each longitudinal edge of the bar, the notches being longitudinally offset from one another, the pusher top wall and bottom wall having a width that varies in a region where the moveable contact is received to coact with the offset notches so the moveable contact is installed in a proper orientation.

14. The method of claim 13 wherein the top wall includes offset first and second top notches at its first and second longitudinal edges in the region where the moveable contact is received and wherein the bottom wall includes offset first and second bottom notches at its first and second longitudinal edges in the region where the moveable contact is received, and wherein the first top notch is offset from the first bottom notch and the second top notch is offset from the second bottom notch.

15. The method of claim 10 wherein the first and second stationary contacts are of a first configuration for normally closed operation and a second configuration for normally open operation, the configurations being selected so that the movable contact does not contact the stationary contacts if an incorrect configuration is fixedly mounted in the enclosure.

16. The method of claim 10 wherein the pusher comprises a neck extending through an opening in the enclosure for engagement with the actuator and the enclosure comprises an asymmetric rib on one side of the opening and the pusher comprises an asymmetric notch in the top wall on one side of the neck receiving the rib to prevent incorrect assembly of the pusher in the enclosure.

17. The method of claim 10 wherein the top ribs are spaced from the bottom ribs to define slots therebetween, the slots, in cross section, being partially circular.

18. The method of claim 10 wherein the pusher further comprises third and fourth side walls connected between the top wall and the bottom wall to define an opening having respective first and fourth ends, third and fourth longitudinally spaced top ribs on an inside of the top wall proximate the respective third and fourth side walls, third and fourth longitudinally spaced bottom ribs on an inside of the bottom wall proximate the respective third and fourth side walls and laterally offset from the respective third and fourth top ribs to define respective third and fourth slots therebetween.

19. The method of claim 18 further comprising inserting a second contact spring in one of the third or fourth slots between the top rib and the bottom rib at the respective third or the fourth end of the opening, the contact spring extending to the top rib and the bottom rib at the other of the third end and fourth end of the opening, and inserting a second moveable contact in the pusher by inserting the second moveable contact in the other of the third and fourth slots, pressing the moveable contact against the second contact spring and rotating the second moveable contact to engage the top rib and the bottom rib at the other of the third end and fourth end of the opening so the second contact spring biases the second moveable contact against the top rib and the bottom rib at the other of the third end and fourth end of the opening.

* * * * *